US012434161B2

(12) United States Patent
Lunde et al.

(10) Patent No.: US 12,434,161 B2
(45) Date of Patent: Oct. 7, 2025

(54) MODULAR SENSORY PLATFORM

(71) Applicant: Technifex Products, LLC, Valencia, CA (US)

(72) Inventors: Montgomery C. Lunde, Marina del Rey, CA (US); Joseph E. Ortiz, Canyon Country, CA (US); Howard D. Smith, Glendale, CA (US); Leonard M. Aboulache, Valencia, CA (US)

(73) Assignee: Technifex Products, LLC, Valencia, CA (US)

( * ) Notice: Subject to any disclaimer, the term of this patent is extended or adjusted under 35 U.S.C. 154(b) by 544 days.

(21) Appl. No.: 17/986,639

(22) Filed: Nov. 14, 2022

(65) Prior Publication Data

US 2023/0149822 A1 May 18, 2023

Related U.S. Application Data

(60) Provisional application No. 63/278,983, filed on Nov. 12, 2021.

(51) Int. Cl.
*G08B 21/00* (2006.01)
*A63G 31/04* (2006.01)

(52) U.S. Cl.
CPC ..... *A63G 31/04* (2013.01)

(58) Field of Classification Search
CPC ..... A63G 31/04; A63G 31/14; A63G 31/16; A63J 2005/003; A63J 2005/005; A63J 2005/008; A63J 5/02; A63J 5/025
See application file for complete search history.

(56) References Cited

U.S. PATENT DOCUMENTS

| | | | | |
|---|---|---|---|---|
| 8,077,884 | B2 * | 12/2011 | Oser | H04R 5/023 381/396 |
| 9,597,252 | B2 * | 3/2017 | Bub | E01C 5/001 |
| 10,310,610 | B2 * | 6/2019 | Krogstad | A63F 13/25 |
| 10,456,694 | B1 * | 10/2019 | Smoot | E04B 5/43 |
| 10,858,845 | B1 * | 12/2020 | Majewski | H04R 1/025 |

* cited by examiner

*Primary Examiner* — Toan N Pham
(74) *Attorney, Agent, or Firm* — Sheridan Law, LLC; James A. Sheridan

(57) ABSTRACT

There is disclosed a modular sensory platform for generating an experience for a guest on the platform located on an event floor of a venue. At least one deck module may each include a frame with a bottom side for mounting to the event floor, a side edge bordering the frame, and a standing surface opposite the bottom for supporting the guest. Lift actuators may be positioned along the side edge or under the deck for changing a distance between the event floor and the standing surface according to a lift signal. One or more sensory stimuli each receivable of a stimulus signal may be mounted to the frame and include at least one of a vibration buzzer, a low-frequency transducer, smoke effects, a heater, a water spritzer, air and scent lines, an air blaster and scent emission, a haptic device, fiber optic lighting, LED lighting, and a fog unit.

20 Claims, 8 Drawing Sheets

Sensory Deck Module

Concave Platform Surface

Deck Articulation

Motion Envelopes

MODULAR SENSORY PLATFORM

CROSS REFERENCE TO RELATED APPLICATIONS

This patent application claims priority to U.S. Provisional Application No. 63/278,983 filed on Nov. 12, 2021 and entitled MODULAR SENSORY PLATFORM, the entire contents of Application 63/278,983 being expressly incorporated by reference herein.

BACKGROUND

Traditionally, an experiential performance event or haunted house tour may rely on homemade or piecemeal enhancements to the sensory environment, such as overhead lighting and a mood-setting soundtrack. A museum tour, for example, may simulate ancient village life with a static set of local plants and buildings and a headphone recording or written placards guiding one through the tour. Unfortunately, the experience of a guest traveling though a low-budget event may be humdrum.

In a more elaborate or income-generating production, such as a theme park event or a flight simulator, the creators of the show may procure a custom virtual reality (VR) set with 2-way responsivity, motion platforms having six degrees of freedom (6DOF), and/or wind generators, fog, and other special effects. However, putting together an elaborate event or simulator tends to require a custom design, be very costly, have a long lead time, and serves a very exclusive clientele. A venue may also vary in floor area from tens of square feet to thousands of square feet, again requiring a custom design for each entertainment or training event.

In summary, there is gap in the art between event enhancements which are boring and inexpensive and those which highly impactful but prohibitively expensive.

SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an embodiment, there is disclosed a modular sensory platform for amplifying a virtual reality, augmented reality, or real experience, including, but not limited to, haunted houses, training environments, museums, and other virtual and "real" experiences (henceforth "guest experience") for a guest residing on the sensory platform located on an event floor of a venue. The platform may comprise an array of one or more standardized deck modules configurable to provide a contiguous platform walking area. Each of the one or more deck modules may have a deck frame with frame corners and a base deck for mounting to the event floor. The platform may further comprise a side edge bordering each of the decks, and a deck standing surface opposite the bottom side and removably mountable to each of the deck frames for supporting the guest.

The platform may further comprise a lift actuator positioned near multiple frame corners in the array for changing an actuating distance between the event floor and the standing surface according to a lift signal for each of the lift actuators. The actuating distance may be variable over a vertical travel. The platform may further comprise a predefined deck gap between any two adjacent decks in the contiguous array. One or more articulating joints may attach to the side edges corresponding to the predefined deck gap and thereby stabilize the deck gap while allowing the vertical travel.

The platform may further comprise a platform controller connectable to one or more of the deck modules in the array and preconfigurable to select or provide the lift signal for each of the lift actuators. The lift actuator may be configured to lift a corner from each of two decks when exactly two decks meet at their common corner. The platform controller may be configured to generate lift signals for achieving at least one of the following motion envelopes of the array for amplifying the guest experience: a ripple pattern, a uniform rise, a uniform drop, a tilt, a convex shape, and a concave shape.

In another embodiment, there is disclosed a modular sensory platform for generating or amplifying a guest experience on the sensory platform located on an event floor of a venue. The platform may comprise at least one deck module each having a deck frame with a base deck mounted to the event floor. A standing surface may removably mount to the deck frame opposite the base deck for supporting the guest. A side edge may border each deck module.

The platform may further comprise at least one lift actuator positioned along the side edge of or under at least one of the decks for changing an actuating distance between the event floor and the corresponding standing surface according to a lift signal for each actuator. The actuating distance may be variable over a vertical travel. One or more sensory stimuli may each be receivable of a stimulus signal and may be configured for mounting within each of the at least one deck module. The stimuli may include one or more of a vibration buzzer, a low-frequency transducer, a smoke effects unit, a heater, a water spritzer, air blast and scent supply lines, an air blaster and scent emitter, a haptic device, fiber optic lighting, LED lighting, and a fog unit.

The platform may further include a platform controller connected to each of the at least one deck and which may be preconfigured to select or provide the stimulus signal for each of the one or more sensory stimuli. The platform controller may also be preconfigured to select or provide the lift signal for each of the at least one lift actuator. One or both of the low frequency transducer and the vibration buzzer may be mounted such that a vibration in the standing surface is excitable. The platform controller may be configured to coordinate with event activities of the venue in order to further generate or amplify the guest experience.

In yet another embodiment, there is disclosed a method for generating or amplifying a virtual reality, augmented reality, or real experience for a guest attending an entertainment, display, performance, or training event in a venue. The method may comprise aggregating a plurality of standardized deck modules, each having a frame with corners. The deck modules may further include a side edge bordering the deck, a bottom side resting on an event floor of the venue, and a standing surface opposite the bottom side. A deck gap between adjacent decks of the plurality may be less than 1 inch for establishing a contiguous platform walking area The method may further include integrating one or more sensory stimuli into each of the plurality of decks, where each stimuli may be receivable of a stimulus signal. The stimuli may include one or more of a vibration buzzer, a low-frequency transducer, a smoke effects unit, a water spritzer, a fog unit, air lines to an air blaster, scent lines for emitting scent, a heater, LED lighting, fiber optic lighting, and a haptic device. The method may further include mounting a lift actuator near the corners of each of the plurality of decks. The lift actuator may be capable of changing a distance between the event floor and the standing surface according to a lift signal.

The method may further comprise applying the stimulus signals to the one or more sensory stimuli via a platform controller and according to an experiential program of the controller coordinating with the event. The stimulus signals may generate one or more of the following effects for the guest: haptic, sound, smoke, mist, fog, air blast, scent, heat, and lighting. The method may further comprise applying the lift signals to the lift actuators via the platform controller and according to the experiential program. The lift actuators may generate one or more of the following motion envelopes in the platform walking area: a ripple pattern, a uniform rise, a uniform drop, a tilt, a convex shape, and a concave shape. Together, the platform walking area, the sensory stimuli, the lift actuators, and the platform controller may form the modular sensory floor generating or amplifying the guest experience.

Additional objects, advantages and novel features of the technology will be set forth in part in the description which follows, and in part will become more apparent to those skilled in the art upon examination of the following or may be learned from practice of the technology.

BRIEF DESCRIPTION OF THE DRAWINGS

Non-limiting and non-exhaustive embodiments of the present invention, including the preferred embodiment, are described with reference to the following figures, wherein like reference numerals refer to like parts throughout the various views unless otherwise specified. Illustrative embodiments of the invention are illustrated in the drawings, in which.

DETAILED DESCRIPTION

Figure 1:
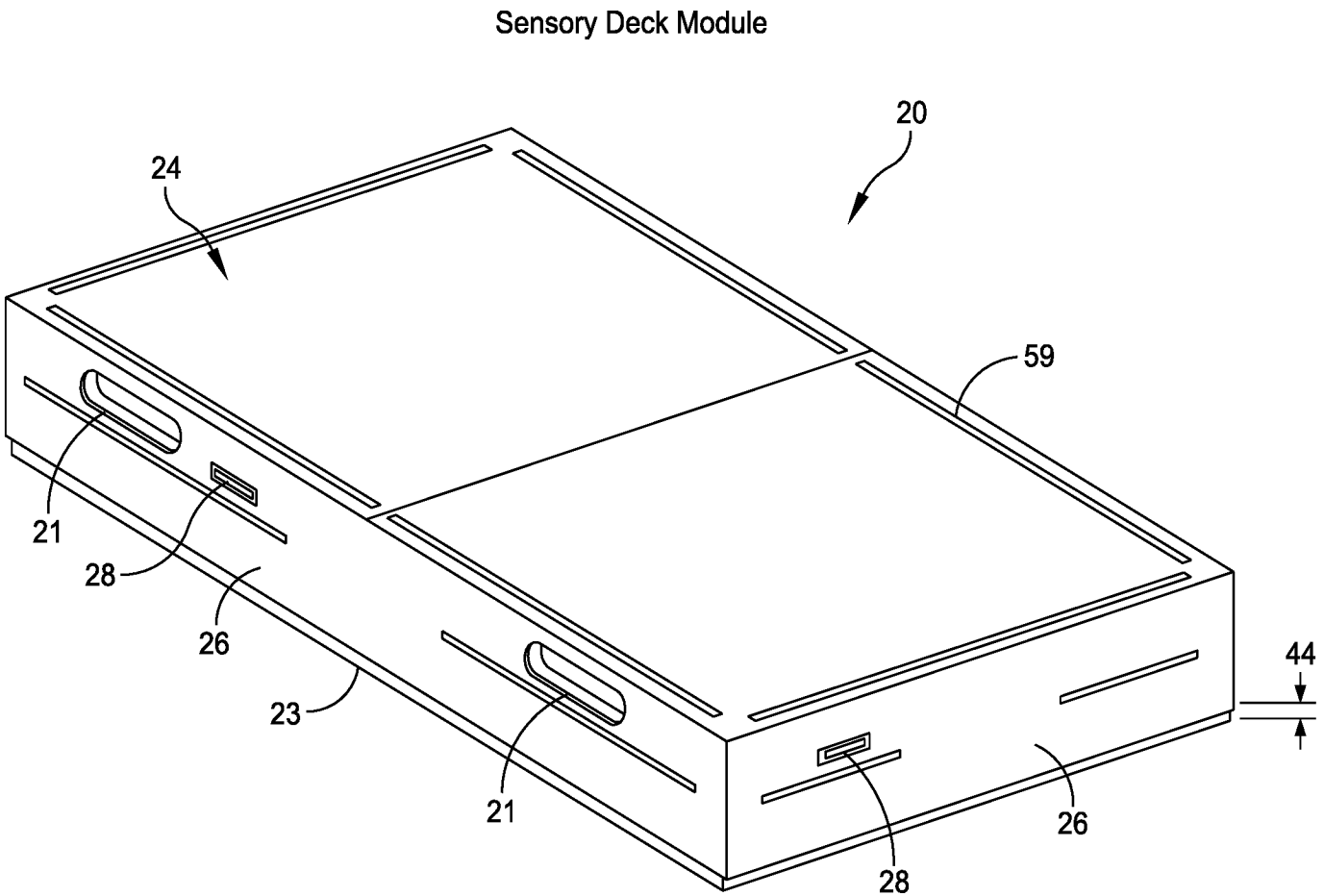
FIG. 1 illustrates a perspective view of a sensory deck module in a modular sensory platform, in accordance with an embodiment of the present disclosure.

Embodiments are described more fully below in sufficient detail to enable those skilled in the art to practice the system and method. However, embodiments may be implemented in many different forms and should not be construed as being limited to the embodiments set forth herein. The following detailed description is, therefore, not to be taken in a limiting sense.

When elements are referred to as being "connected" or "coupled," the elements can be directly connected or coupled together, or one or more intervening elements may also be present. In contrast, when elements are referred to as being "directly connected" or "directly coupled," there are no intervening elements present.

The subject matter may be embodied as devices, systems, methods, and/or computer program products. Accordingly, some or all the subject matter may be embodied in hardware and/or in software (including firmware, resident software, micro-code, state machines, gate arrays, etc.) Furthermore, the subject matter may take the form of a computer program product on a computer-usable or computer-readable storage medium having computer-usable or computer-readable program code embodied in the medium for use by or in connection with an instruction execution system. In the context of this document, a computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, device, or propagation medium. By way of example, and not limitation, computer readable media may comprise computer storage media and communication media.

Computer storage media includes volatile and nonvolatile, removable, and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information, and which can accessed by an instruction execution system. Note that the computer-usable or computer-readable medium could be paper or another suitable medium upon which the program is printed, as the program can be electronically captured, via, for instance, optical scanning of the paper or other medium, then compiled, interpreted, of otherwise processed in a suitable manner, if necessary, and then stored in a computer memory.

Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer readable media.

When the subject matter is embodied in the general context of computer-executable instructions, the embodiment may comprise program modules, executed by one or more systems, computers, or other devices. Generally, program modules include routines, programs, objects, components, data structures, etc. that perform particular tasks or implement particular abstract data types. Typically, the functionality of the program modules may be combined or distributed as desired in various embodiments.

As may be appreciated, based on the disclosure, there exists a need in the art for a low-cost sensory platform providing a standardized module integrated with a palette of adjustable sensory stimuli which enhance an entertainment, display, performance, or training event. Additionally, there exists a need in the art for a modular system for generating or amplifying a guest experience for venues whose floor area varies widely. Further, there exists a need in the art for implementing a simplified enhancement to an event experience in a short timeline.

First described are some integrated modular components of the disclosed system, followed by an aggregation of those components to form a complete system.

Figure 2:
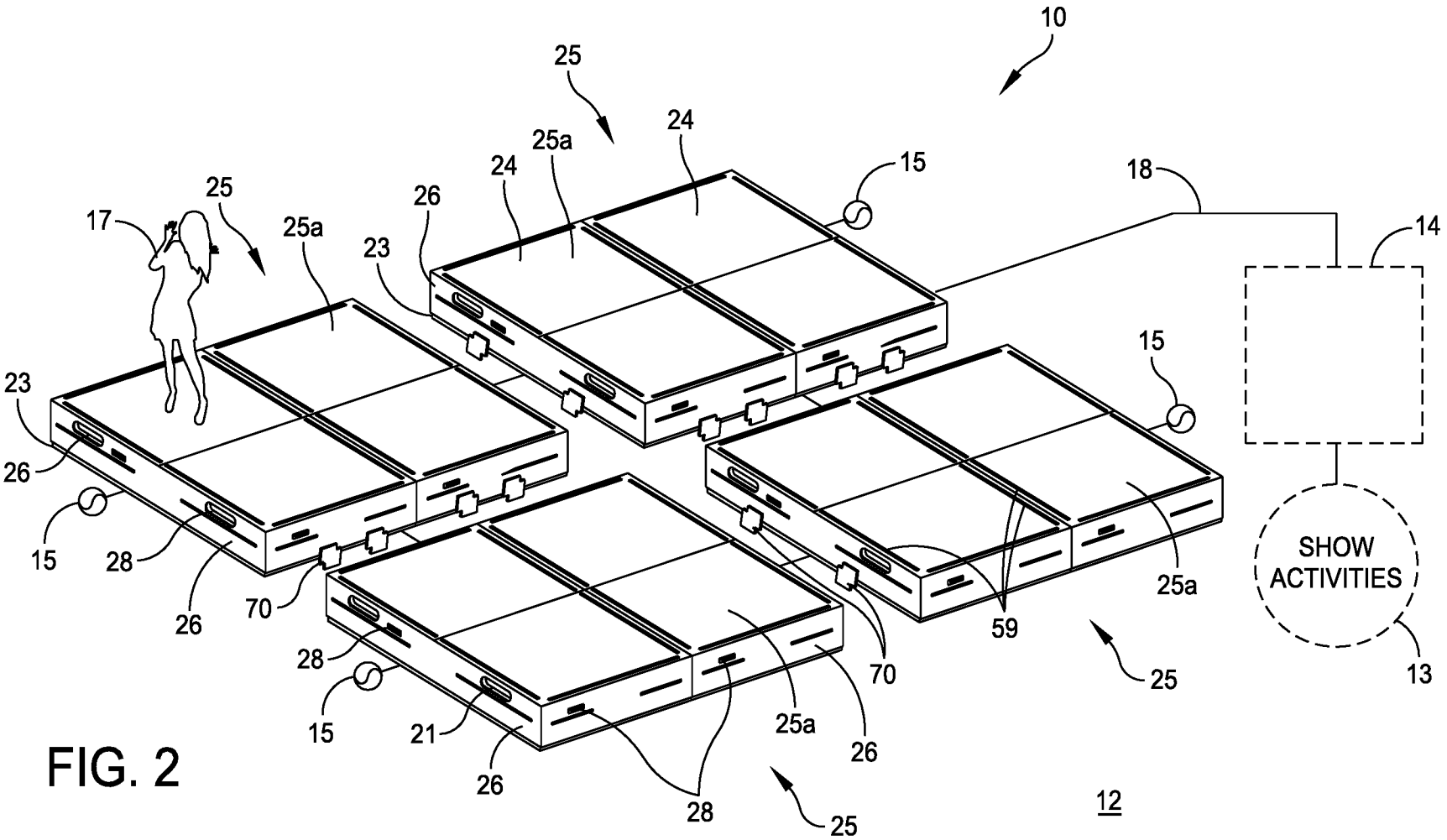
FIG. 2 illustrates a control diagram for an aggregation of the deck modules for a modular sensory platform in an event environment, in accordance with an embodiment of the present disclosure.

Referring to FIGS. 1-5, in various embodiments, a modular sensory platform 10 may generate or amplify a guest 17 experience on the sensory platform 10 which may be located on an event floor 11 (FIG. 5) of a venue 12 (FIG. 2). The platform 10 may include at least one deck module 20 each having a deck frame 22 with a base deck (bottom side) 23 mountable to the event floor 11. Each deck module 20 may include a standing surface 24 removably mountable to the deck frame 22 opposite the base deck 23 and configured to support the guest 17. The standing surface 24 may be a non-slip covering. A side edge 26 may border each of the decks 20.

The venue 12 may be a theater, a theme park, a museum, a training center, a concert hall, or any location where creators of event activities 13 (FIG. 2) may wish to deepen a somatic experience of the guest 17. Event activities 13 (experiential event) of the venue 12 may include one or more of a virtual reality program, an immersive theme experience, a museum display, a training simulator, a haunted house, a movie queue, a video broadcast, recorded music, a theater production, a concert, and an extreme environment simulator. The modular sensory platform 10 may be configured to amplify a virtual reality (VR), augmented reality, or real experience of the guest 17.

Continuing, at least one lift actuator 30 may be positioned along the side edge 26 or under at least one of the decks 20 for changing an actuating distance 42 (FIG. 5) between the event floor 11 and the corresponding standing surface 24. Each of the lift actuators 30 (FIG. 4) may be directed to extend or retract in accordance with a lift signal (not shown) supplied to each actuator. The actuating distance 42 may vary over a vertical travel 44 (FIG. 1). For example, the vertical travel 44 between a maximum and minimum distance 42 may be approximately one inch. Alternatively, the vertical travel 44 of the deck 20 may be configured to be several inches.

Referring still to FIGS. 1-5, in various embodiments, the lift actuator 30 may be actuated by pneumatic, hydraulic, or electric means, and the lift signal may be a control of air pressure, hydraulic pressure, or electrical signaling, respectively. For example, the lift signal may be an electrical signal delivered to the lift actuators 30 for simulating an earthquake for the guest 17 standing on the deck 20, for enhancing a musical track generated by loudspeakers in the venue 12, or for tilting the deck 20 for amplifying a virtual reality experience. The deck modules 20 may conform to a standard size for modular aggregation of multiple decks, and may be rectangular with frame corners 27 of the deck frame 22. Signaling the lift actuators 30 which are each positioned at the frame corners 27 of the deck may produce one or more of a tilt, a uniform rise, and a uniform drop in the standing surface.

Figure 4:
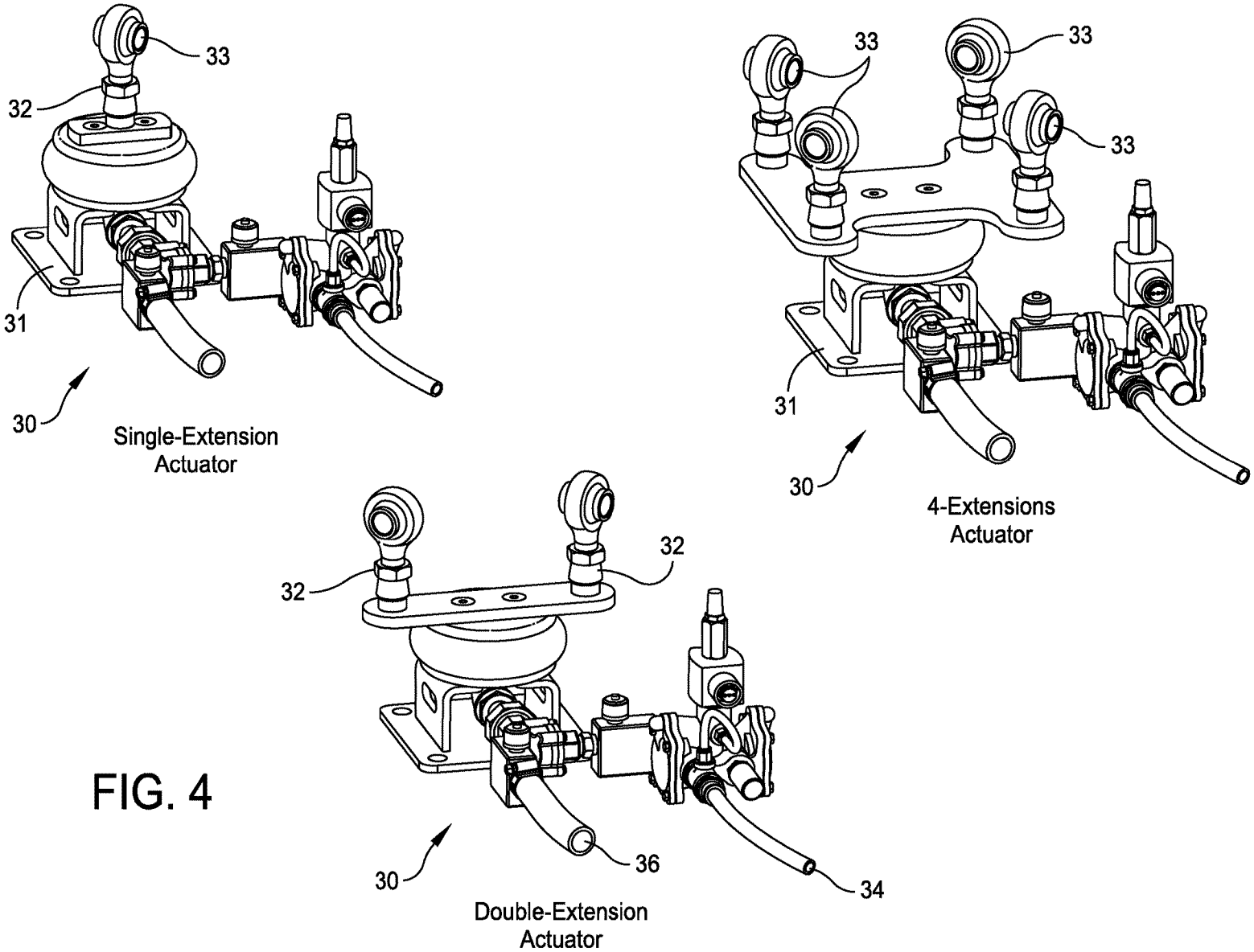
FIG. 4 illustrates lift actuators in a modular sensory platform, in accordance with an embodiment of the present disclosure.

Referring to FIG. 4, in various embodiments, the lift actuator 30 may include a mounting base (or floor base) 31 for mounting to or positioning on the event floor 11. Mounting base 31 may be a flat mounting base for mounting to the event floor 11. The actuator 30 may also include an extension 32 opposite the mounting base for attaching to the deck module 20 and effecting the vertical travel 44. In one embodiment, the extension 32 may be an extension rod, as shown in FIG. 4, projecting upwards for attachment to the deck 20. Alternatively, the extension 32 may be a lateral or vertical flange or plate (not shown) attachable to the side edge 26 or bottom side 23 of the deck frame 22.

Continuing with FIG. 4, a pneumatic actuator 30 may include an air input hose 34 for receiving air pressure to create the vertical travel 44, an air exhaust hose 36 for retracting the actuator 30, and a control valve (not shown) for controlling the actuator 30. A solenoid (not shown) may be included for electrically engaging the actuator 30. In one embodiment, the actuator 30 may be mounted to the event floor 11 and the to the deck frame 22 above. In alternative embodiments, the deck may comprise a lower section (not shown) mounted to the floor 11 and an upper section (not shown) to which the standing surface 24 is mounted, where the actuators 30 may be integral to the deck and in between the lower and the upper sections of the deck 20.

Figure 3:
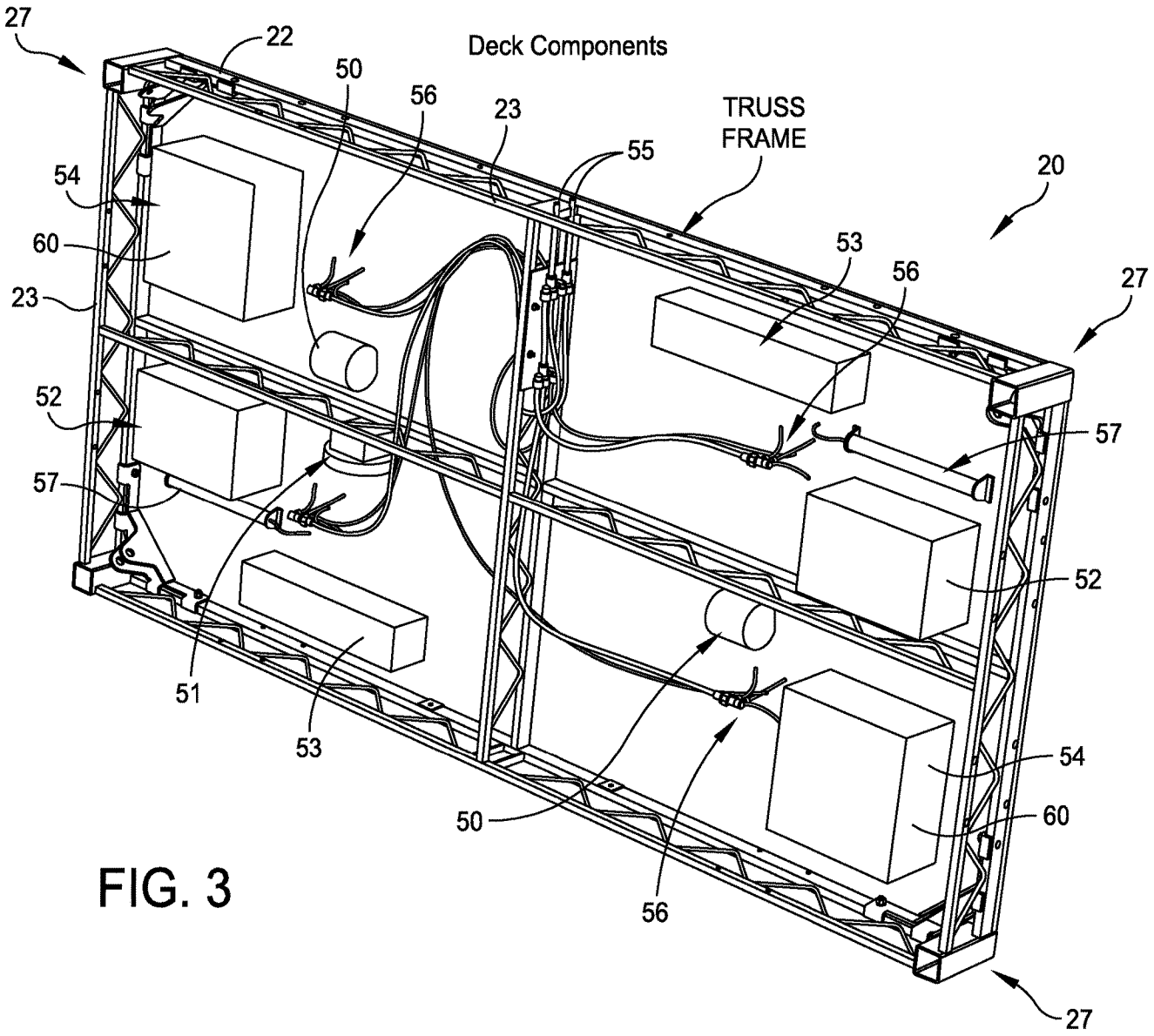
FIG. 3 illustrates an underside view of a deck module for a modular sensory platform, in accordance with an embodiment of the present disclosure.

Referring now to FIG. 3, in various embodiments, one or more sensory stimuli may be mounted within each deck 20 to enhance the somatic experience of the guest 17. Each of the sensory stimuli may be receivable of a stimulus signal (not shown) for controlling the stimuli. The one or more sensory stimuli may be configured for mounting within each of the at least one deck module 20, the stimuli including one or more of a vibration buzzer 50, a low-frequency transducer 51, a smoke effects unit 52, a heater 53, a water spritzer 54, air blast and scent supply lines 55, an air blaster and scent emitter 56, a haptic device 57, fiber optic lighting (not shown), LED lighting 59 (FIG. 1), and a fog unit 60. In a preferred embodiment, the one or more stimuli may be mounted underneath the standing surface 24, with the exception of lighting 58 and 59.

Now referring to FIGS. 1-3, in various embodiments, each sensory stimulus may be configured to receive the stimulus signal from a platform controller 14 of the modular sensory platform 10. The platform controller 14 may be configured to connect to each deck 20 and may be preconfigured to select or provide the stimulus signal for each of the one or more sensory stimuli. The platform controller 14 may also be preconfigured to select or provide the lift signal for each lift actuator 30 and may be configured to coordinate with activities 13 of the event for a synchronized virtual reality, augmented reality, or real experience.

Continuing, in various embodiments, the haptic device 57 may be any device that stimulates a sense of touch. For example, the haptic device may be incorporated as a leg tickler 57 comprising one or more pneumatically actuated hose whips (not shown) extending upward from the standing surface 24 and fed by air pressure from the air supply line 55. The fog unit 60 may be mounted to the deck frame 22 and may be configured to release fog or mist upwards through slits or apertures in the standing surface 24 when signaled by the platform controller 14. The fog unit may also serve as a plenum for storing at least one of fog and mist prior to release.

One or both of the low frequency transducer 51 and the vibration buzzer 50 may be mounted such that vibration is directly coupled to the standing surface 24 when signaled by the platform controller 14. For example, one or both of the low frequency transducer 51 and the vibration buzzer 50 may be mounted to the deck frame 22 and/or the underside of the standing surface 24 in order to excite a vibration in the standing surface 24. The low frequency transducer 51 may be configured to generate sound at or below the low end of the human audio spectrum (e.g., 20-100 Hz). The vibration buzzer 50 may also be a knocker device (not shown) that delivers a percussive impulse to the deck frame 22 in a way that conducts the impulse to the guest 17. Each deck 20 may include one or more low frequency transducers and/or one or more vibration buzzers, or may not include any low frequency transducers or vibration buzzers.

Figure 8:
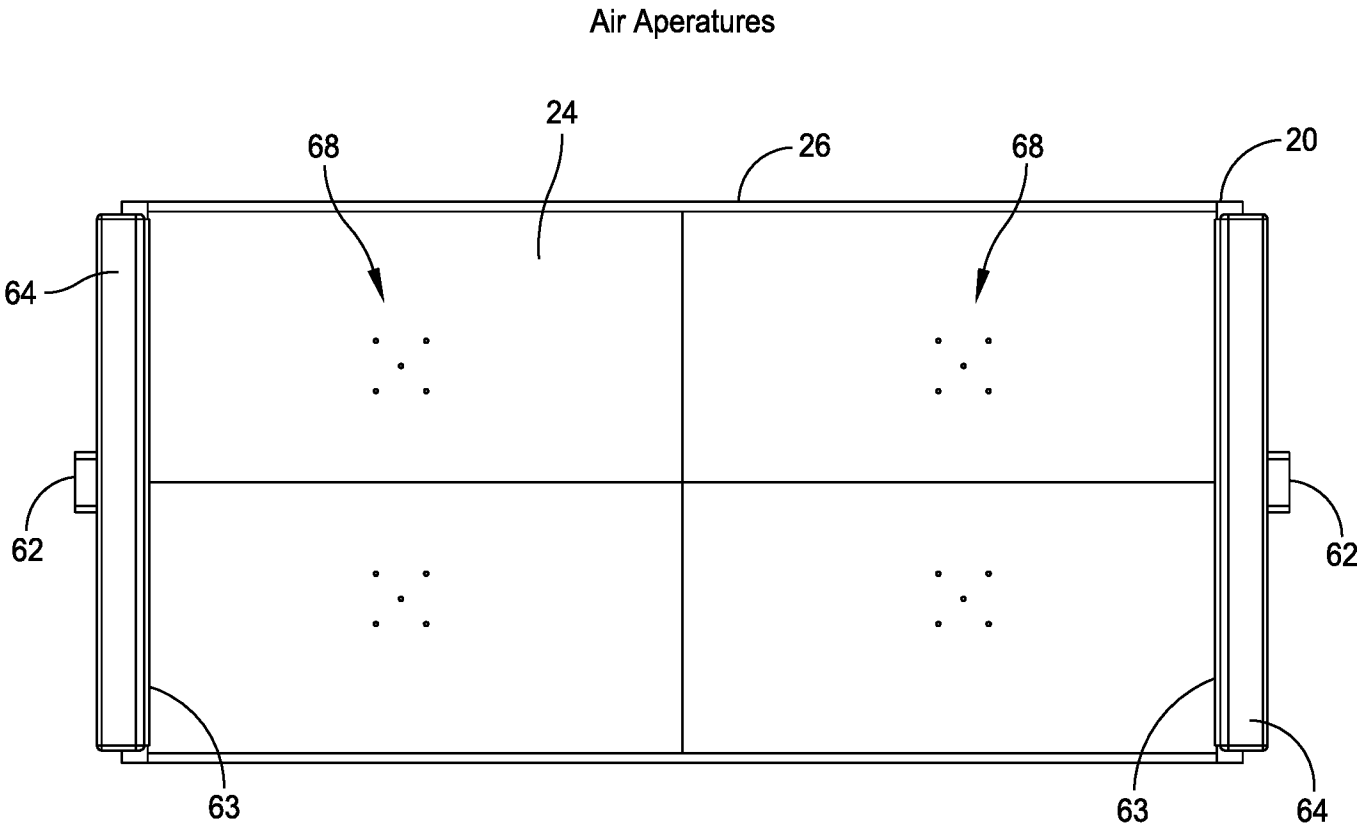
FIG. 8 illustrates air apertures for an air blaster in a modular sensory platform, in accordance with an embodiment of the present disclosure.

Referring now to FIGS. 3 and 8, in various embodiments, the air and scent lines 55 may be configured to receive the respective stimulus signals from the platform controller 14 for controlling the air blaster and scent emission 56. The standing surface 24 may include multiple air apertures 68 in the standing surface connectable to one or both of the air scent lines for providing the air blast and the scent stimulus, respectively. The standing surface of each deck may be divided into quadrants with a grouping of several air apertures in the center of each quadrant. The air blast and scent tubing may terminate at an air/scent inlet on the side edge of each deck for connection to the control and data line delivering stimulus input signals.

Referring to FIGS. 1 and 2, in various embodiments, LED strip lighting 59 may be positioned along the side edges 26 and/or the standing surface 24 of the deck 20. Fiber optic lighting 58 (not shown) may be embedded in the standing surface 24 and may be fed with a light source. Lighting 58 and 59 may be turned on and off by respective stimulus signaling from the platform controller 14. An experiential program of the program controller may synchronize stimulus signaling and actuator signaling with event activities 13 of the event to amplify the guest experience. LED lighting may also be synchronized with other stimuli of the sensory platform, such as the low frequency transducers or the vibration buzzer. Alternatively, the LED lighting may illuminate the platform when ambient lighting is low or may direct guests to various portions of the platform in synchrony with activities of an immersion experience or a training event.

Referring to FIGS. 2-3, in various embodiments, a control and data line 18 may conduct the lift and the stimulus signals from the platform controller 14 to each of the deck modules 20, where the control and data line 18 may include wired and/or wireless connections. The control and data line 18 may include one or both of an air supply for the air blaster and air pressure for actuating the lift actuators. The control and data line 18 may also include a cable for conducting stimulus and lift signals including one or more of control signals and audio signals for the low frequency transducers 51 and/or vibration buzzer 50. A set of input terminals on the low frequency transducer 51 may connect to an audio input signal source located either on the deck 20 or in the platform controller 14. Additionally, vibration buzzers 50 may be configured to be controlled via the control and data line 18 (FIG. 2) to provide the stimulus signal producing the sound or vibration.

Continuing with FIGS. 2 and 3, a portion of a functionality of the platform controller 14 may be distributed onto a deck controller (not shown) disposed on each deck 20 for one or more of aggregating control and data delivery at a central location, storing sensory signals or signals such as scents and audio tracks, audio processing and amplification functions for driving the low frequency transducers 51 and/or vibration buzzers 50, and storing preconfigured audio patterns selectable by a user of the sensory platform 10.

Continuing, the platform controller 14 may be preconfigurable by providing an option to store one or more lift signals for actuating the lift actuator 30, or may be preconfigurable by providing an option to select a pre-stored lift signal. The platform controller 14 may also be configured to respond to real time effects triggers (not shown), based on guest interaction, through an effects feed connection 28. The decks 20 may include sensors, such as a pressure sensor or a motion sensor, that respond to the weight of the guest 17 by turning on and off portions of the LED lighting 59. The decks 20 may also include sensory inputs for receiving guest inputs, such as a GPS location or heart rate, from a smart phone of the guest which may then provide a sensory response, such as turning on the LED lightning, stimulating the vibration buzzer, or any other stimuli built into the standing deck. The sensory inputs and the guest responses may be routed through the effects feed connection 28 and through control and data line 18 to platform controller 14.

The platform controller 14 may also be preconfigurable by providing an option to store one or more stimulus signals for activating one or more of the sensory stimuli or may be preconfigurable by providing an option to select from multiple pre-stored stimulus signals. For example, the signaling of the scent blaster 56 may include storing one or more scents within each of the decks where the platform controller 14 may include a user interface (not shown) for selecting which scent to release at a particular rate, time, and duration. In another example, the stimulus signal for the low frequency transducer 51 may include one or more audio profiles selectable for routing to the low frequency transducer 51. Alternately, the signal for the low frequency transducer 51 may be an input from any audio source.

Continuing with FIGS. 2 and 3, in various embodiments, a selected lift signal may specify one or more of on/off times, a vibration frequency, an amount of the vertical travel, and an air pressure for the lift actuator 30. The control and data line 18 may control the delivery of air pressure to the air input hoses 34 of the lift actuators 30. Control and data line 18 may also deliver NC power and data to trigger the scent 56, water 54, fog or mist 60, and lighting 58 and 59. The platform controller 14 may also deliver data and control information through wireless means such as a WiFi or cloud networking. NC power 15 may preferably be delivered to each deck separately from the control and data line 18.

Now referring to FIGS. 2 and 5-7, in various embodiments, an array 25 of standardized deck modules 20 may be configured to form a contiguous platform walking area 25*a*. A predefined deck gap 74 may be established between any two adjacent decks 20 in the contiguous array 25. The decks 20 may be a standardized rectangle, square, or other regular polygon for forming a contiguous array 25. One or more articulating joints 70 may link the side edges 26 corresponding to each deck gap 74 for bridging and stabilizing the adjacent decks 20 while allowing free movement during lift actuation. Alternatively, mounting the lift actuators 30 to the event floor 11 may stabilize the decks at the predefined deck gap 74 without using the joints 70. Beneficially, the modular sensory platform 10 may be configured as any contiguous shape 25*a* and size (FIG. 7) that may thereby accommodate a wide range of venues 12.

Continuing, the articulating joint 70 may be a hinge allowing the adjacent decks to articulate in a vertical plane perpendicular to the deck gap 74. The deck gap 74 may be less than around one inch. In a preferred embodiment, the predefined deck gap may be less than around ½ inch. The hinge 70 may comprise two vertical pads or plates (not shown) attachable to the side edge of each of the adjacent decks and linked by a hinge pin parallel to and between the two side edges. To facilitate vertical deck travel, each of the plates may further be housed in a sliding jacket (not shown). Alternately, the articulating joint may be constructed of a flap of rubber or elastomer fastened to each of the adjacent side edges 26 or standing surface 24 for stretching during up or down movement of the decks 20.

Figure 5:
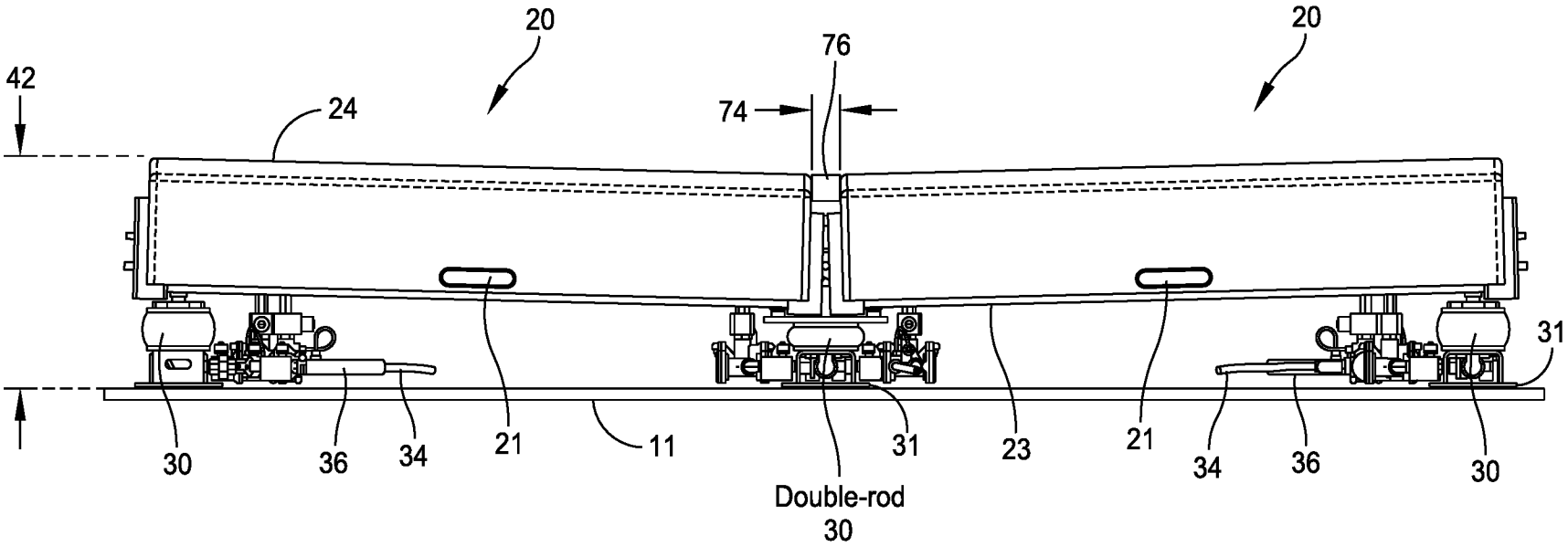
FIG. 5 illustrates a side view of a concave motion in a modular sensory platform, in accordance with an embodiment of the present disclosure.

Referring to FIGS. 4-5, in an embodiment, the lift actuator 30 may be positioned near or at each frame corner 27 in the array 25 so that one actuator 30 may lift a common frame corner 27 of exactly two adjacent decks. The lift actuator 30 may be configured with two extensions for attaching to and lifting the exactly two adjacent decks meeting at their common corner. Similarly, in the larger arrays 25 of rectangular decks 20 (see FIG. 7), many of the frame corners will be shared by four decks, and the lift actuator 30 may be configured with four extensions for attaching to and lifting exactly four decks at their common corner. For example, the 16-module array in FIG. 7 has seven common corners shared by four decks. Beneficially, the use of double and quadruple-extension actuators 30 may substantially reduce cost, simplify installation, and better stabilize the relative deck positions compared to using single-extension actuators 30.

Referring to FIG. 4, in an embodiment, the actuator extension 32 may include a swivel 33 at an outer end of the extension 32 in order to accommodate oblique angles of the deck 20 as it moves through the actuating distance. In one embodiment, the swivel 33 may be a rod swivel embedded in an end of the extension rod 32. The swivel may be a universal joint of any kind that facilitates a rigid attachment of the deck frame while allowing angular movement of the deck.

In a preferred embodiment, the decks 20 may be dimensioned at a 4×8 feet standard. Alternatively, half-sizes such as 4×4 feet or 2×4 feet, or double sizes such as 8×8 feet, and other integer subsets or supersets of the standard deck size may be combined while meeting a criterion that the corners line up for facilitating a common lift actuator.

Figure 6A:
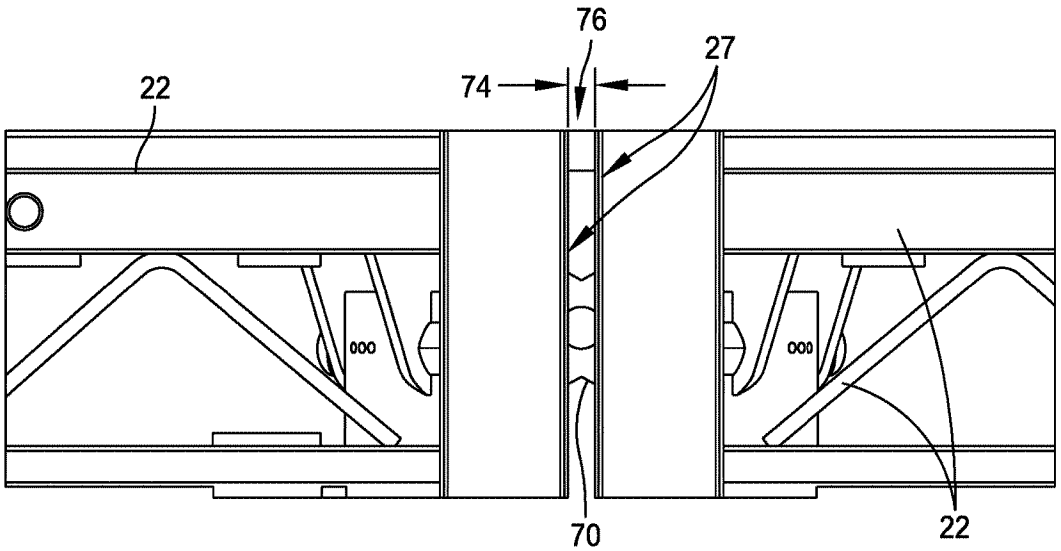
FIG. 6*a* illustrates an articulating joint between two adjacent decks in a modular sensory platform, in accordance with an embodiment of the present disclosure.

Referring now to FIGS. 5 and 6*a*, in various embodiments, one or more elastic gap fillers 76 may be configured to substantially fill the predefined deck gap 74 being stabilized by the one or more articulating joints 70. The gap filler 76 may be a foam strip placed along a portion of the deck gap near the standing surface 24 and above the corresponding one or more articulating joints 70. The foam strip may expand during a convex lifting of the adjacent decks and may compress during a concave sinking of the adjacent decks (FIG. 5), and may thereby prevent tripping as the guest 17 walks across the deck gap 74. In another embodiment not shown, a foam strip may cover the entire length of the deck gap 74. In another embodiment, the deck gap 74 may be covered by a flexible standing surface 24 larger than the size of the deck 20.

Figure 6B:
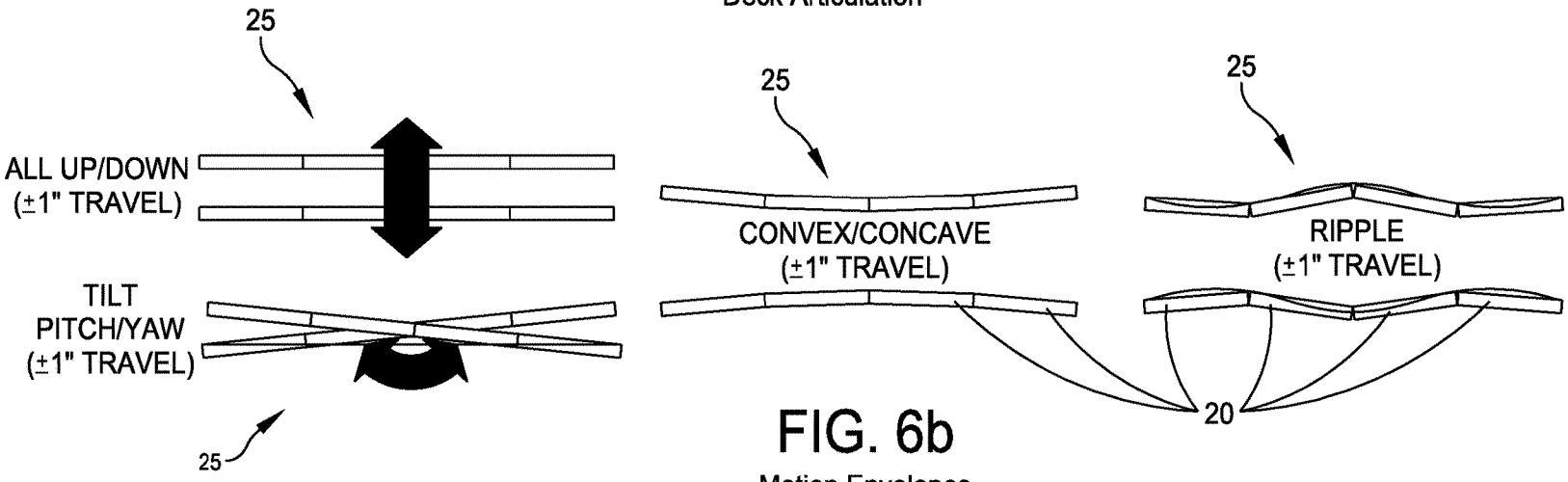
FIG. 6*b* illustrates various motion envelopes in a modular sensory platform, in accordance with an embodiment of the present disclosure.

Referring to FIGS. 5 and 6*b*, in various embodiments, the platform controller 14 may be configured to generate lift signals for achieving at least one of the following motion envelopes (FIG. 6*b*) of the array 25 and thereby amplify the guest experience: a ripple pattern, a uniform rise, a uniform drop, a tilt, a convex shape, and a concave shape. The motion envelope may refer to the shape of the platform walking area 25*a* at a moment in time during articulation (e.g. convex up, tilt). Additionally, the motion envelope may refer to a continuously changing form (e.g. the ripple). A wave or ripple motion may be varied in frequency, wavelength, and/or direction (left-right, forward-back) to produce a three-dimensional effect. Beneficially, this wave action may generate or amplify an experience of an earthquake or ocean surface without the sophistication and expense of a flight simulator having six degrees freedom (6DOF).

In embodiments not shown, a common air inlet on the deck 20 may feed both the air input hoses 34 of the lift actuators 30 and the air inlet lines 55 for the air blaster and the scent emitter 56. The deck 20 may include a deck controller (not shown) for regulating an air pressure of the air blaster and may store and initiate an air blast signal. Also, referring to FIG. 1, one or more handles 21 may be disposed on the deck 20 or carrying and placing the decks onto the event floor 11, and may be recessed concavities or retractable appendages.

Advantageously, a variety of selectable and preconfigurable signals or signals for a variety of sensory stimuli and lift actuators may generate or enhance the guest experience without the cost of a customized product. As indicated herein, the "guest experience" can be virtual reality, augmented reality, or real experience.

Referring to FIG. 8, in an alternative embodiment, a fog plenum 64 may be configured to cap each of short ends of the rectangular deck 20 and may include a fog outlet slot 63 adjacent to and facing toward the standing surface 24 and a fog duct inlet 62 facing away. Additionally, the fog outlets 63 may be vents in the standing deck 24 releasing fog from a plenum underneath standing deck 24.

The platform controller 14 may be configured to coordinate with activities 13 of the event to stimulate or amplify the guest experience. The platform controller 14 may connect to any number of decks 20 through the control and data line 18 and may be preconfigured to select the lift signal for each of the lift actuators 30. A data connection may connect the platform controller 14 to an external event controller (not shown) for controlling activities of the event, such as playing a video, managing stage lighting, or operating robotic characters of an ongoing production. The event data connection may thereby synchronize the operation of the platform controller 14 with queues of the event controller to amplify the overall guest experience.

Figure 7:
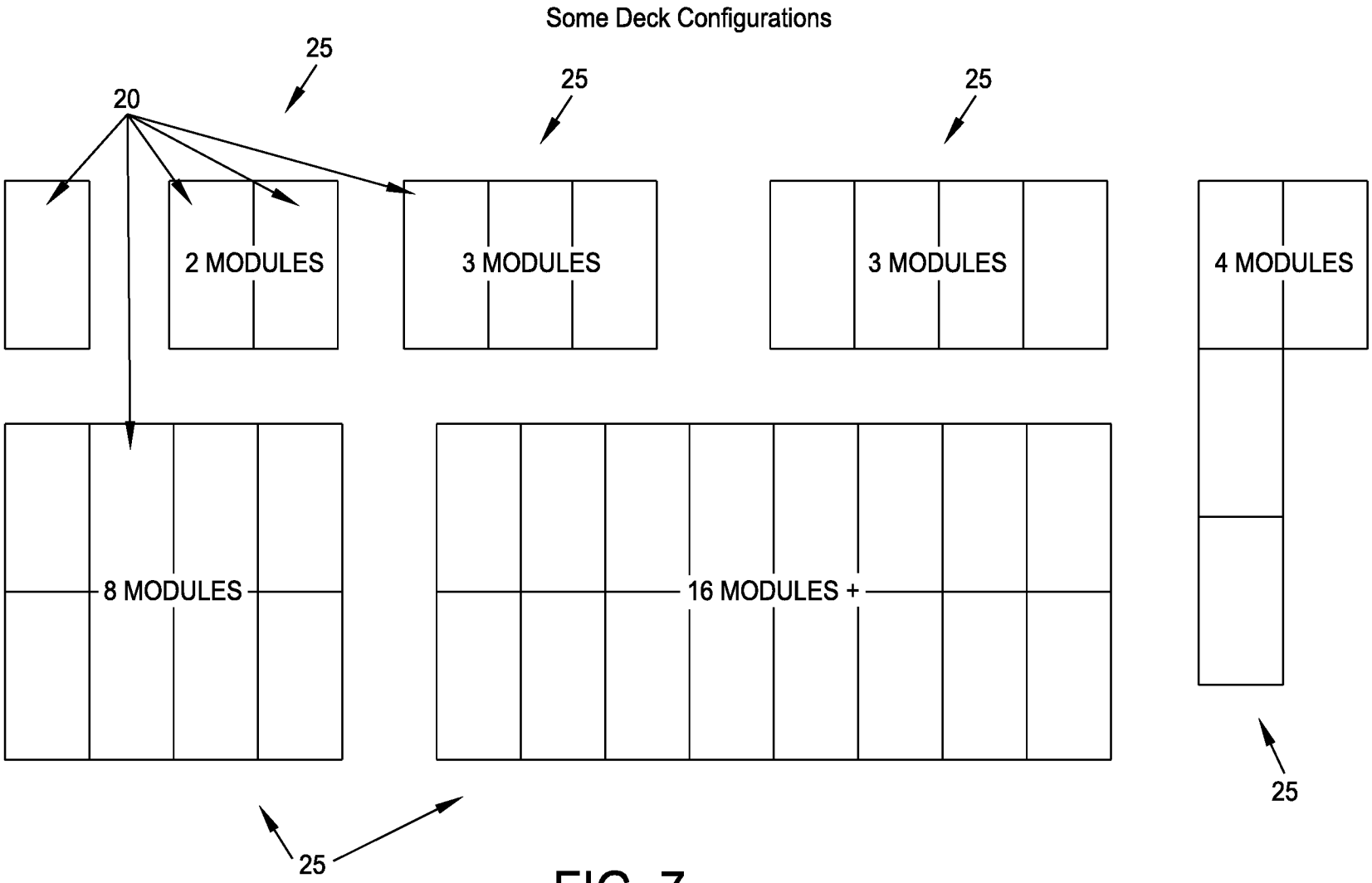
FIG. 7 illustrates a plan view of exemplary deck aggregations in a modular sensory platform, in accordance with an embodiment of the present disclosure.

Referring to FIGS. 2 and 7, in an embodiment, at least one additional deck module 20 may be dispersed from the contiguous array 25 of the one or more standardized deck modules by more than the predefined deck gap 74. The additional decks 20 may provide an additional one or more of the platform walking areas 25*a*, be connected to the platform controller 14, be configured with the lift actuators 30 and the one or more sensory stimuli, and thereby provide a distributed sensory platform 10 in the venue 12.

In summary, generating or amplifying a virtual reality, augmented reality, or real experience for a guest may comprise aggregating a plurality of standardized deck modules 20 and linking the side edges 26 between adjacent decks with an articulating joint 70 for maintaining the predefined deck gap 74. One or more sensory stimuli may be integrated into each of the plurality of decks 20, where each stimuli is receivable of the stimulus signal. The lift actuator 30 may be mounted near the frame corners 27 of each deck 20 for changing the distance 42 between the event floor 11 and the standing surface 24 according to the lift signal. The platform controller 14 may apply, according to an experiential program of the controller coordinated with the event, the stimulus signals to the one or more sensory stimuli. The sensory stimuli may generate one or more of the following effects for the guest: haptic, sound, smoke, mist, fog, air blast, scent, heat, and lighting. The platform controller 14 may apply, according to the experiential program, the lift signals to the lift actuators 30 for creating one or more of the following motion envelopes in the platform walking area 25*a*: a ripple pattern, a uniform rise, a uniform drop, a tilt, a convex shape, and a concave shape.

Although the above embodiments have been described in language that is specific to certain structures, elements, compositions, and methodological steps, it is to be understood that the technology defined in the appended claims is not necessarily limited to the specific structures, elements, compositions and/or steps described. Rather, the specific aspects and steps are described as forms of implementing the claimed technology. Since many embodiments of the technology can be practiced without departing from the spirit and scope of the invention, the invention resides in the claims hereinafter appended.

What is claimed is:

1. A modular sensory platform for generating or amplifying a guest experience on the sensory platform located on an event floor of a venue, the platform comprising:

at least one deck module each having a deck frame with a base deck mountable to the event floor, a standing surface removably mountable to the deck frame opposite the base deck and for supporting the guest, and a side edge bordering each of the at least one deck module;

at least one lift actuator positional along the side edge of or under at least one of the decks for changing an actuating distance between the event floor and the corresponding standing surface according to a lift signal for each actuator, where the actuating distance is variable over a vertical travel;

one or more sensory stimuli each receivable of a stimulus signal and configured for mounting within each of the at least one deck module, the stimuli including one or more of a vibration buzzer, a low-frequency transducer, a smoke effects unit, a heater, a water spritzer, air blast and scent supply lines, an air blaster and scent emitter, a haptic device, fiber optic lighting, LED lighting, and a fog unit;

a platform controller connectable to each of the at least one deck and preconfigurable to select or provide the stimulus signal for each of the one or more sensory stimuli, and preconfigurable to select or provide the lift signal for each of the at least one lift actuator; and where one or both of the low frequency transducer and the vibration buzzer are mounted such that a vibration in the standing surface is excitable, and where the platform controller is configured to coordinate with event activities of the venue to generate or amplify the guest experience.

2. The modular sensory platform of claim 1, wherein:

the event activities of the venue include one or more of a virtual reality program, an immersive theme experience, a museum display, a training simulator, a haunted house, a movie queue, a video broadcast, recorded music, a theater production, a concert, and an extreme environment simulator.

3. The modular sensory platform of claim 1, wherein:

the lift actuator is actuated by pneumatic, hydraulic, or electric means.

4. The modular sensory platform of claim 1, wherein:

the lift actuator includes a flat mounting base mountable to the event floor and an extension opposite the mounting base for attaching to the at least one deck for effecting the vertical travel.

5. The modular sensory platform of claim 1, wherein:

each of the at least one deck is rectangular having corners supportable by one of the at least one lift actuator, where the lift signals applied to the actuators are configurable to achieve at least one of a tilt, a uniform rise, and a uniform drop in the standing surface.

6. The modular sensory platform of claim 5, wherein:

the fog unit is configured at least as a plenum for storing at least one of fog and mist for release upwards through slits or apertures in the standing surface.

7. The modular sensory platform of claim 1, wherein:

the platform includes at least two decks linkable by one or more articulating joints attachable to the side edges for stabilizing a predefined deck gap while allowing the vertical travel, thereby providing a contiguous platform walking surface.

8. The modular sensory platform of claim 1, further comprising:

multiple air apertures in the standing surface connectable to one or both of the air lines and the scent lines for providing the air blast and the scent stimulus, respectively.

9. The modular sensory platform of claim 1, further comprising:

a control and data line for conducting the lift and the stimulus signals from the platform controller to each of the deck modules, where the control and data line may be wired or wireless.

10. The modular sensory platform of claim 9, wherein:

the control and data line includes one or both of an air supply for the air blaster and air pressure for actuating the lift actuators.

11. The modular sensory platform of claim 1, wherein:

the haptic device is a leg tickler comprising one or more pneumatically actuated hose whips extending upward from the standing surface and fed by air pressure from the air supply line.

12. A modular sensory platform for amplifying a virtual reality, augmented reality, or real experience for a guest residing on the sensory platform located on an event floor of a venue, the platform comprising:

an array of one or more standardized deck modules configurable to provide a contiguous platform walking area, each of the one or more deck modules having a deck frame with frame corners and a base deck for mounting to the event floor, a side edge bordering each of the decks, and a deck standing surface opposite the bottom side and removably mountable to each of the deck frames for supporting the guest;

a lift actuator positional near multiple frame corners in the array for changing an actuating distance between the event floor and the standing surface according to a lift signal for each of the lift actuators, where the actuating distance is variable over a vertical travel;

a predefined deck gap between any two adjacent decks in the contiguous array;

one or more articulating joints attachable to the side edges corresponding to the predefined deck gap, the one or more joints for stabilizing the deck gap while allowing the vertical travel;

a platform controller connectable to one or more of the deck modules in the array and preconfigurable to select or provide the lift signal for each of the lift actuators;

where the lift actuator is configured to lift a corner from each of two decks when exactly two decks meet at their common corner; and where the platform controller is configurable to generate lift signals for achieving at least one of the following motion envelopes of the array and thereby amplify the guest experience: a ripple pattern, a uniform rise, a uniform drop, a tilt, a convex shape, and a concave shape.

13. The modular sensory platform of claim 12, further comprising:

one or more sensory stimuli each receivable of a stimulus signal and configured for mounting within each of the at least one deck module, the stimuli including one or more of a vibration buzzer, a low-frequency transducer, a smoke effects unit, a heater, a water spritzer, air blast and scent supply lines, an air blaster and scent emitter, a haptic device, fiber optic lighting, LED lighting, and a fog unit.

14. The modular sensory platform of claim 13, wherein:

the lift actuator is configurable with two extensions for attaching to and lifting exactly two decks meeting at their common corner, and is configurable with four extensions for attaching to and lifting exactly four decks meeting at their common corner.

15. The modular sensory platform of claim 12, further comprising:

the lift actuator including a floor base mountable to the event floor, at least one extension opposite the floor base for attaching to the one or more deck modules for effecting the vertical travel, and a swivel connected to the extension for accommodating oblique angles imposed when the deck moves through the actuating distance.

16. The modular sensory platform of claim 12, wherein:

the articulating joint is a hinge allowing the adjacent decks to articulate in a vertical plane perpendicular to the deck gap.

17. The modular sensory platform of claim 12, further comprising:

one or more elastic gap fillers for substantially filling the predefined deck gap being stabilized by the one or more articulating joints.

18. The modular sensory platform of claim 12, further comprising:

at least one additional deck module dispersible from the contiguous array of the one or more standardized deck modules, the additional decks providing an additional one or more of the platform walking areas, the additional decks being dispersed by more than the predefined deck gap, connectable to the platform controller, configurable with the lift actuators, and providing a distributed sensory platform in the venue.

19. A method for generating or amplifying a virtual reality, augmented reality, or real experience for a guest attending an entertainment, display, performance, or training event in a venue, the method comprising:

aggregating a plurality of standardized deck modules each having a frame with corners, a side edge bordering the deck, a bottom side resting on an event floor of the venue, and a standing surface opposite the bottom side, where a deck gap between adjacent decks of the plurality is less than 1 inch for establishing a contiguous platform walking area;

integrating one or more sensory stimuli into each of the plurality of decks and each receivable of a stimulus signal, the stimuli including one or more of a vibration buzzer, a low-frequency transducer, a smoke effects unit, a water spritzer, a fog unit, air lines to an air blaster, scent lines for emitting scent, a heater, LED lighting, fiber optic lighting, and a haptic device;

mounting a lift actuator near the corners of each of the plurality of decks for changing a distance between the event floor and the standing surface according to a lift signal for each of the lift actuators;

applying via a platform controller, according to an experiential program of the controller coordinated with the event, the stimulus signals to the one or more sensory stimuli for generating one or more of the following effects for the guest: vibration, sound, smoke, mist, fog, air blast, scent, heat, lighting, and touch;

applying via the platform controller, according to the experiential program, the lift signals to the lift actuators for creating one or more of the following motion envelopes in the platform walking area: a ripple pattern, a uniform rise, a uniform drop, a tilt, a convex shape, and a concave shape; and where the platform walking area, sensory stimuli, lift actuators, and platform controller form a modular sensory floor for generating or amplifying the guest experience.

20. The method of claim 19, further comprising:

linking the side edges between adjacent decks in the plurality of decks with an articulating joint for maintaining the deck gap while allowing the platform motion.

* * * * *